US011519126B2

(12) United States Patent
Leibman et al.

(10) Patent No.: US 11,519,126 B2
(45) Date of Patent: Dec. 6, 2022

(54) DOOR ASSEMBLY FOR AN APPLIANCE

(71) Applicant: Haier US Appliance Solutions, Inc., Wilmington, DE (US)

(72) Inventors: Alexander B. Leibman, Prospect, KY (US); Venkata Chakradhar Rangu, Hyderabad (IN)

(73) Assignee: Haier US Appliance Solutions, Inc., Wilmington, DE (US)

( * ) Notice: Subject to any disclaimer, the term of this patent is extended or adjusted under 35 U.S.C. 154(b) by 76 days.

(21) Appl. No.: 17/146,790

(22) Filed: Jan. 12, 2021

(65) Prior Publication Data

US 2022/0220658 A1 Jul. 14, 2022

(51) Int. Cl.

| | |
|---|---|
| ***D06F 39/14*** | (2006.01) |
| ***D06F 58/20*** | (2006.01) |
| ***D06F 39/02*** | (2006.01) |
| ***D06F 37/42*** | (2006.01) |

(52) U.S. Cl.

CPC ..... *D06F 39/14* (2013.01); *D06F 37/42* (2013.01); *D06F 39/02* (2013.01); *D06F 58/203* (2013.01)

(58) Field of Classification Search

CPC ..... D06F 39/14; D06F 39/02; D06F 37/42; D06F 58/203

USPC ..... 68/196

See application file for complete search history.

(56) References Cited

U.S. PATENT DOCUMENTS

| | | | |
|---|---|---|---|
| 8,991,877 | B2 | 3/2015 | Spiessl |
| 2008/0106105 | A1* | 5/2008 | Spiessl ..... A47L 15/4259 292/210 |
| 2015/0014306 | A1 | 1/2015 | Monahan et al. |
| 2019/0071815 | A1* | 3/2019 | Woodham, Jr. ..... D06F 39/14 |
| 2020/0025392 | A1 | 1/2020 | Balekundri et al. |
| 2020/0069146 | A1 | 3/2020 | Kessler et al. |

FOREIGN PATENT DOCUMENTS

| | | | |
|---|---|---|---|
| CN | 105737223 | B | 12/2017 |
| DE | 102006058322 | B4 | 5/2012 |
| DE | 102011088676 | A1 | 6/2013 |
| GB | 2458438 | A | 9/2009 |
| JP | 2001/057132 | A | 2/2001 |
| JP | 2008/132257 | A | 6/2008 |

(Continued)

OTHER PUBLICATIONS

KR20170105201A—Machine translation (Year: 2017).*
KR101099326B1—Machine translation (Year: 2011).*
JP2008132257A—Machine translation (Year: 2008).*

*Primary Examiner* — Tinsae B Ayalew

(74) *Attorney, Agent, or Firm* — Dority & Manning, P.A.

(57) ABSTRACT

A door assembly for a horizontal axis appliance having a cabinet with a front panel defining an opening and a tub positioned within the cabinet includes a primary door rotatably mounted to the front panel to permit selective access to the opening, a secondary door secured on an exterior side of the primary door, an interior cavity defined between the primary door and the secondary door, one or more electrical components arranged within the interior cavity, and an electrical closing mechanism for securing the primary door and the secondary door in a closed position. Thus, when the primary door and the secondary door are in the closed position, the electrical closing mechanism powers the one or more electrical components.

19 Claims, 15 Drawing Sheets

(56) References Cited

FOREIGN PATENT DOCUMENTS

| | | | |
|---|---|---|---|
| JP | 4772068 | B2 | 9/2011 |
| KR | 100209803 | B1 | 7/1999 |
| KR | 101099326 | B1 | 12/2011 |
| KR | 101484945 | B1 | 1/2015 |
| KR | 2017/0105201 | A | 9/2017 |
| KR | 2020/0101738 | A | 8/2020 |
| WO | WO2019/120343 | A1 | 6/2019 |

* cited by examiner

DOOR ASSEMBLY FOR AN APPLIANCE

FIELD OF THE INVENTION

The present subject matter relates generally to door assemblies for appliances, or more specifically, to door assemblies having a primary door and a secondary door arranged together to define an interior cavity therebetween for housing various electrical components for use with the appliance.

BACKGROUND OF THE INVENTION

Washing machine appliances generally include a tub for containing water or wash fluid, e.g., water and detergent, bleach, and/or other wash additives. A basket is rotatably mounted within the tub and defines a wash chamber for receipt of articles for washing. Further, the washing machine appliances includes a rotatable, primary door to permit selective access to an opening of the wash chamber. During normal operation of such washing machine appliances, the wash fluid is directed into the tub and onto articles within the wash chamber of the basket. The basket or an agitation element can rotate at various speeds to agitate articles within the wash chamber, to wring wash fluid from articles within the wash chamber, etc.

After articles are washing via the washing machine appliance, the wet articles are commonly transferred to a dryer appliance for drying. Dryer appliances typically include a cabinet with a drum rotatably mounted therein. Further, the dryer appliance includes a rotatable, primary to permit selective access to an opening of the drum. During operation, a motor rotates the drum, e.g., to tumble the wet articles located within a chamber defined by the drum. An air handler or blower moves air heated by a heater assembly through the chamber in order to dry moisture-laden articles positioned therein. Such components are housed within a cabinet.

In certain instances, such appliances may include a secondary door as part of the primary door. Thus, the secondary door provides another means to access the wash chamber (or the drum) without having to open the primary door. Moreover, for many appliances, a spring-loaded door switch may be used to detect if the primary door is closed. In particular, a compression spring switch is mounted on an apron such that, when the appliance's door closes, the door pushes and compresses the spring and closes electrical switch contacts. A wire harness carries the signal to the electronic boards such that the appliance can then be operated as designed. Existing mechanical door switches, however, can be prone to malfunctions, such as sticking.

Accordingly, an appliance having improved features that address the aforementioned issues is desirable. More particularly, an appliance having a door assembly with a primary door and a secondary door arranged together to define a interior cavity therebetween for housing various electrical components for use with the appliance would be welcomed in the art, particularly one that includes improved closing means.

BRIEF DESCRIPTION OF THE INVENTION

Aspects and advantages of the invention will be set forth in part in the following description, or may be apparent from the description, or may be learned through practice of the invention.

In an aspect, the present disclosure is directed to an appliance. The appliance includes a cabinet including a front panel. The front panel defines an opening. The tub is positioned within the cabinet. The appliance also includes a basket rotatably mounted within the tub. The basket defines a chamber for receiving articles for washing or drying. The appliance also includes a door assembly positioned proximate the opening. The door assembly includes a primary door rotatably mounted to the front panel to permit selective access to the opening and a secondary door secured on an exterior side of the primary door. Further, the door assembly includes an interior cavity defined between the primary door and the secondary door and one or more electrical components arranged within the interior cavity. Moreover, the door assembly includes an electrical closing mechanism for securing the primary door and the secondary door in a closed position. Thus, when the primary door and the secondary door are in the closed position, the electrical closing mechanism powers the electrical component(s).

In another aspect, the present disclosure is directed to a door assembly for a horizontal axis appliance. The appliance has a cabinet including a front panel defining an opening and a tub positioned within the cabinet. The door assembly includes a primary door rotatably mounted to the front panel to permit selective access to the opening, a secondary door secured on an exterior side of the primary door, an interior cavity defined between the primary door and the secondary door, one or more electrical components arranged within the interior cavity, and an electrical closing mechanism for securing both the primary door and the secondary door in a closed position. Thus, when the primary door and the secondary door are in the closed position, the electrical closing mechanism powers the one or more electrical components.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
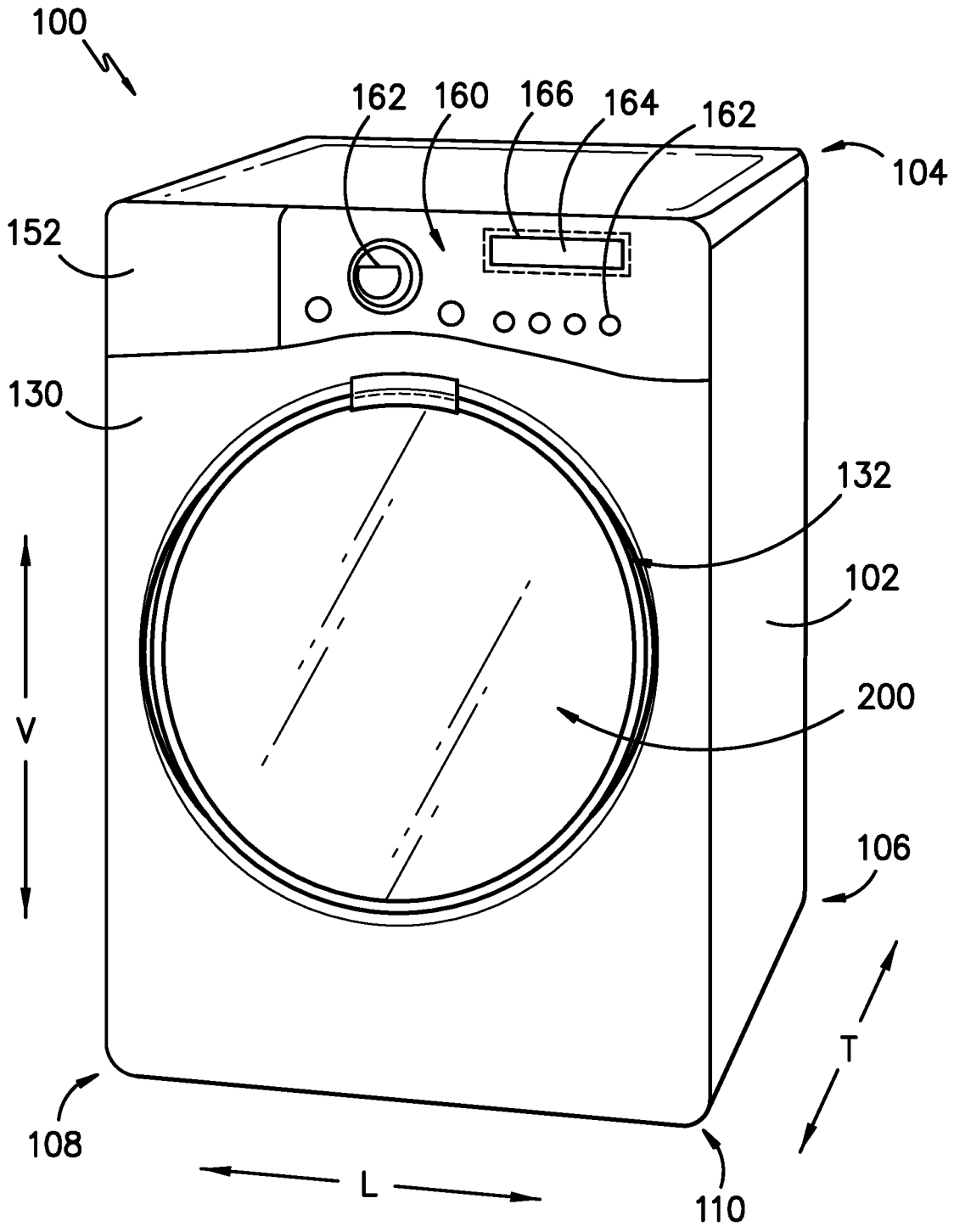
FIG. 1 provides a perspective view of an exemplary washing machine appliance according to an exemplary embodiment of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Generally, the present disclosure is directed to an appliance having a unique door assembly. The appliance may be, for example, a washing machine appliance or a dryer appliance. In particular, the door assembly includes a primary door rotatably mounted to a front panel of the appliance to permit selective access to an opening in the front panel. Further, the door assembly includes a secondary door secured on an exterior side of the primary door. Moreover, an interior cavity is defined between the primary and secondary doors. As such, one or more electrical components are arranged within the interior cavity, such as a scent dispensing system, a water mist system, a pre-treat system, and/or a UV light. In addition, the door assembly includes an electrical closing mechanism for securing the primary and secondary doors in a closed position. Thus, when the primary door and the secondary door are in the closed position, the electrical closing mechanism powers the electrical component(s).

Figure 2:
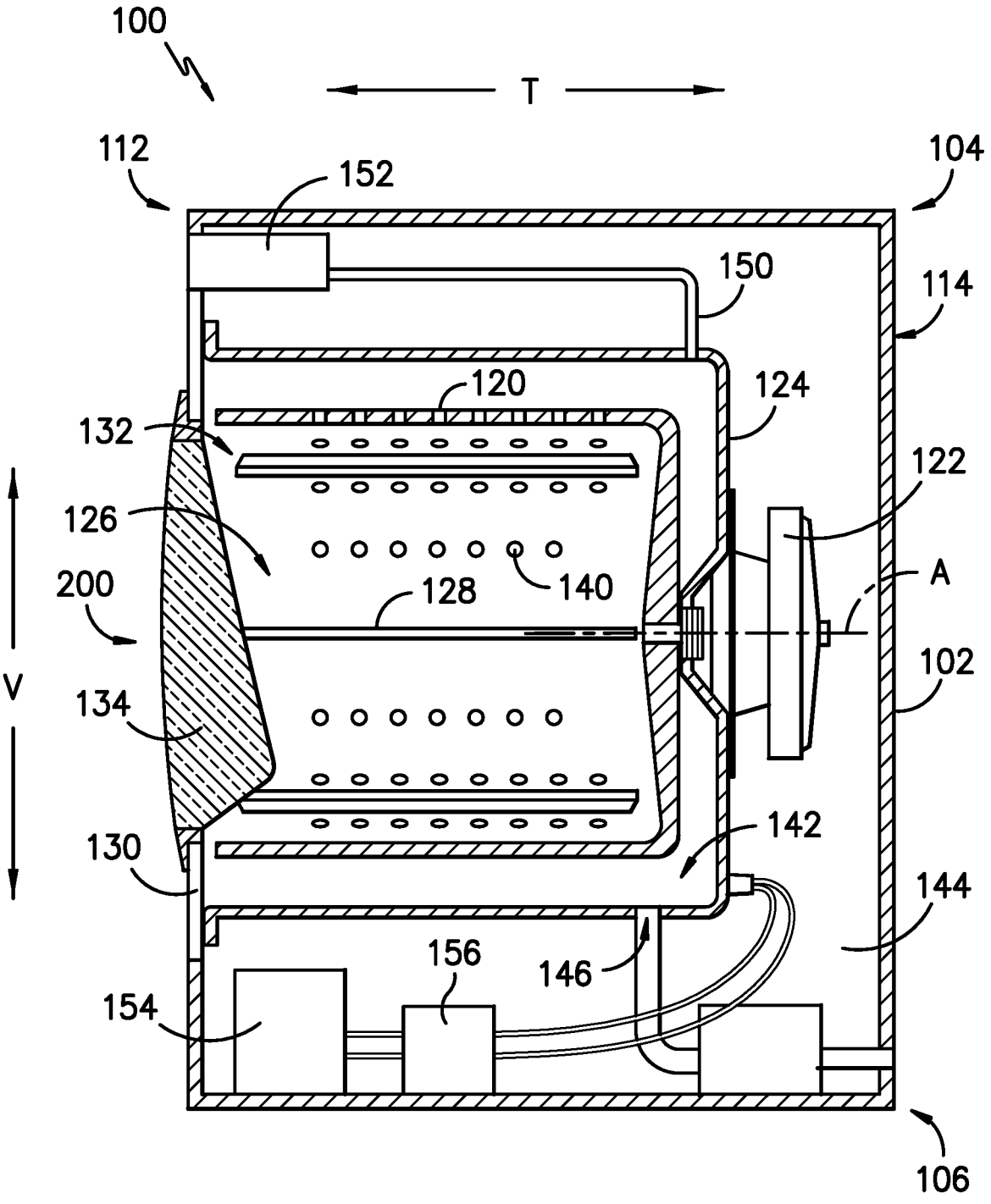
FIG. 2 provides a side cross-sectional view of the exemplary washing machine appliance of FIG. 1.

Referring now to the figures, FIG. 1 illustrates a perspective view of an exemplary horizontal axis front-load washing machine appliance 100 and FIG. 2 illustrates a side cross-sectional view of washing machine appliance 100. As illustrated, washing machine appliance 100 generally defines a vertical direction V, a lateral direction L, and a transverse direction T, each of which is mutually perpendicular, such that an orthogonal coordinate system is generally defined. Further, as shown, the washing machine appliance 100 includes a cabinet 102 that extends between a top 104 and a bottom 106 along the vertical direction V, between a left side 108 and a right side 110 along the lateral direction, and between a front 112 and a rear 114 along the transverse direction T.

Referring particularly to FIG. 2, a wash basket 120 is rotatably mounted within cabinet 102 such that it is rotatable about an axis of rotation A. A motor 122, e.g., such as a pancake motor, is in mechanical communication with wash basket 120 to selectively rotate wash basket 120 (e.g., during an agitation or a rinse cycle of washing machine appliance 100). Wash basket 120 is received within a wash tub 124 and defines a wash chamber 126 that is configured for receipt of articles for washing. The wash tub 124 holds wash and rinse fluids for agitation in wash basket 120 within wash tub 124. As used herein, "wash fluid" may refer to water, detergent, fabric softener, bleach, or any other suitable wash additive or combination thereof.

The wash basket 120 may define one or more agitator features that extend into the wash chamber 126 to assist in agitation and cleaning articles disposed within wash chamber 126 during operation of washing machine appliance 100. For example, as illustrated in FIG. 2, a plurality of ribs 128 may extend from the basket 120 into wash chamber 126. In this manner, for example, the ribs 128 may lift articles disposed in the wash basket 120 during rotation of wash basket 120.

Referring generally to FIGS. 1 and 2, the cabinet 102 also includes a front panel 130 which defines an opening 132 that permits user access to wash basket 120 of wash tub 124. More specifically, the washing machine appliance 100 includes a door assembly 200 (as described in detail below) that is positioned over the opening 132 and is rotatably mounted to front panel 130. More specifically, the door assembly 200 is rotatable about a door axis 203 (see FIG. 6) that is substantially parallel to the vertical direction V. In this manner, the door assembly 200 permits selective access to the opening 132 by being movable between an open position (not shown) facilitating access to a wash tub 124 and a closed position (FIG. 1) prohibiting access to wash tub 124.

Referring again to FIG. 2, the wash basket 120 also defines a plurality of perforations 140 in order to facilitate fluid communication between an interior of basket 120 and wash tub 124. A sump 142 is defined by the wash tub 124 at a bottom of wash tub 124 along the vertical direction V. Thus, the sump 142 is configured for receipt of and generally collects wash fluid during operation of the washing machine appliance 100. For example, during operation of the washing machine appliance 100, wash fluid may be urged by gravity from the basket 120 to the sump 142 through plurality of perforations 140. A pump assembly 144 maybe located beneath the tub 124 for gravity assisted flow when draining tub 124, e.g., via a drain 146. Further, the pump assembly 144 is also configured for recirculating wash fluid within wash tub 124.

As shown particularly in FIG. 2, a spout 150 may be configured for directing a flow of fluid into the wash tub 124. For example, the spout 150 may be in fluid communication with a water supply (not shown) in order to direct fluid (e.g., clean water) into the wash tub 124. The spout 150 may also be in fluid communication with the sump 142. For example, the pump assembly 144 may direct wash fluid disposed in sump 142 to spout 150 in order to circulate wash fluid in wash tub 124.

As illustrated in FIG. 2, a detergent drawer 152 is slidably mounted within front panel 130. The detergent drawer 152 receives a wash additive (e.g., detergent, fabric softener, bleach, or any other suitable liquid or powder) and directs the fluid additive to wash chamber 124 during operation of the washing machine appliance 100. According to the illustrated embodiment, the detergent drawer 152 may also be fluidly coupled to spout 150 to facilitate the complete and accurate dispensing of wash additive.

Additionally, a bulk reservoir 154 may be disposed the within cabinet 102. The bulk reservoir 154 is also configured for receipt of fluid additive for use during operation of washing machine appliance 100 (shown in FIG. 1). Further, the bulk reservoir 154 may be sized such that a volume of fluid additive sufficient for a plurality or multitude of wash cycles of washing machine appliance 100 (e.g., five, ten, twenty, fifty, or any other suitable number of wash cycles) may fill bulk reservoir 154. Thus, for example, a user can fill bulk reservoir 154 with fluid additive and operate washing machine appliance 100 for a plurality of wash cycles without refilling bulk reservoir 154 with fluid additive. A reservoir pump 156 is configured for selective delivery of the fluid additive from the bulk reservoir 154 to wash tub 124.

As shown particularly in FIG. 1, a control panel 160 including a plurality of input selectors 162 may be coupled to the front panel 130. As such, the control panel 160 and the input selectors 162 collectively form a user interface input for operator selection of machine cycles and features. For example, in one embodiment, a display 164 indicates selected features, a countdown timer, and/or other items of interest to machine users.

Operation of the washing machine appliance 100 is controlled by a controller or processing device 166 (FIG. 1) that is operatively coupled to control panel 160 for user manipulation to select washing machine cycles and features. In response to user manipulation of control panel 160, the controller 166 operates the various components of the washing machine appliance 100 to execute selected machine cycles and features.

During operation of the washing machine appliance 100, laundry items are loaded into the wash basket 120 through the opening 132, and washing operation is initiated through operator manipulation of input selectors 162. The wash tub 124 is filled with water, detergent, and/or other fluid additives, e.g., via spout 150 and or detergent drawer 152. One or more valves (not shown) can be controlled by the washing machine appliance 100 to provide for filling wash basket 120 to the appropriate level for the amount of articles being washed and/or rinsed. By way of example for a wash mode, once the wash basket 120 is properly filled with fluid, the contents of the wash basket 120 can be agitated (e.g., with ribs 128) for washing of laundry items in wash basket 120.

After the agitation phase of the wash cycle is completed, the wash tub 124 can be drained. Laundry articles can then be rinsed by again adding fluid to wash tub 124, depending on the particulars of the cleaning cycle selected by a user. The ribs 128 may again provide agitation within the wash basket 120. One or more spin cycles may also be used. In particular, a spin cycle may be applied after the wash cycle and/or after the rinse cycle in order to wring wash fluid from the articles being washed. During a spin cycle, the basket 120 is rotated at relatively high speeds. After articles disposed in the wash basket 120 are cleaned and/or washed, the user can remove the articles from wash basket 120, e.g., by opening the door assembly 200 and reaching into wash basket 120 through the opening 132.

While described in the context of a specific embodiment of horizontal axis washing machine appliance 100, using the teachings disclosed herein it will be understood that horizontal axis washing machine appliance 100 is provided by way of example only. Other washing machine appliances having different configurations, different appearances, and/or different features may also be utilized with the present subject matter as well, e.g., vertical axis washing machine appliances. Moreover, aspects of the present subject matter may be used in any other consumer or commercial appliance where it is desirable to facilitate quick and easy application of a wash additive for a pretreat operation.

Figure 3:
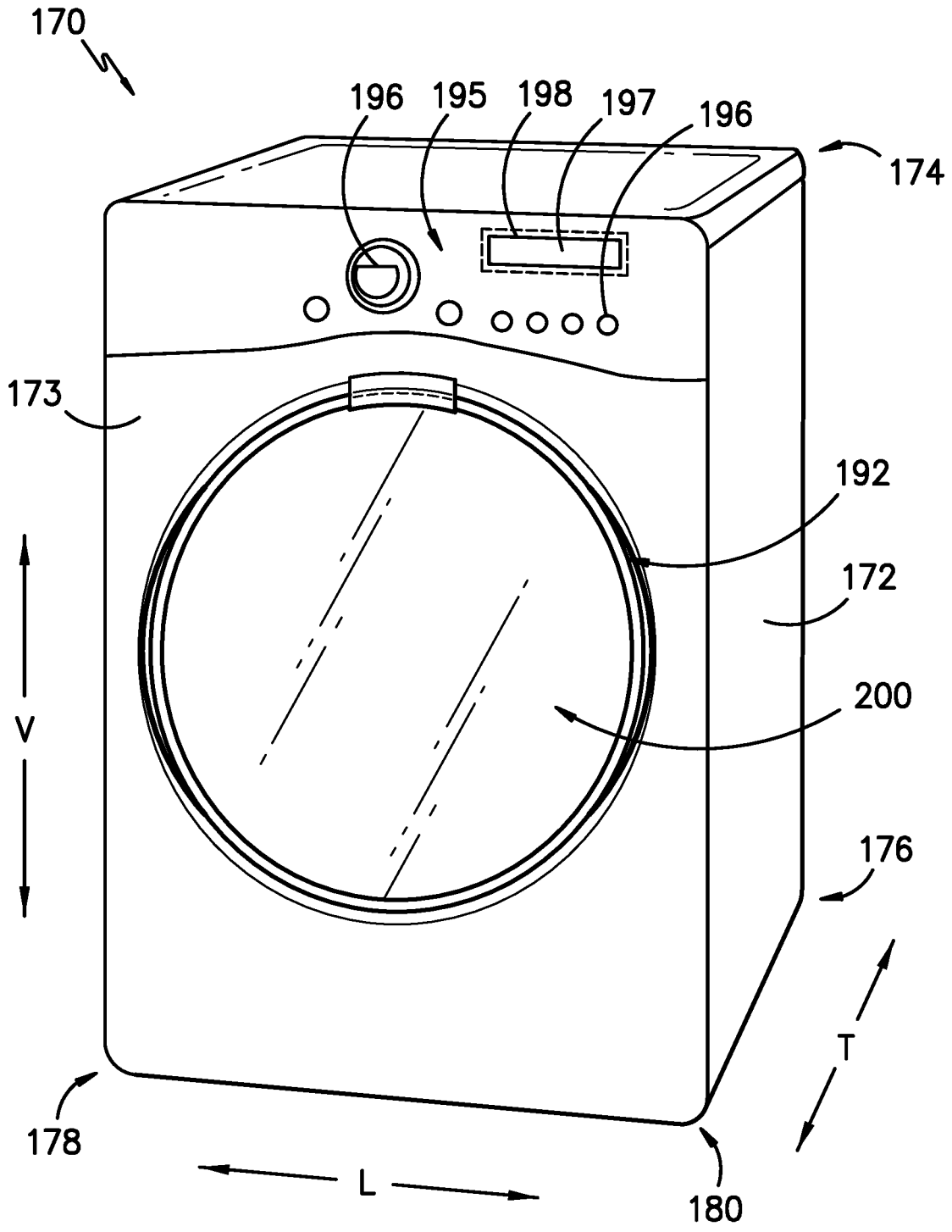
FIG. 3 provides a perspective view of a dryer appliance according to exemplary embodiments of the present disclosure.
Figure 4:
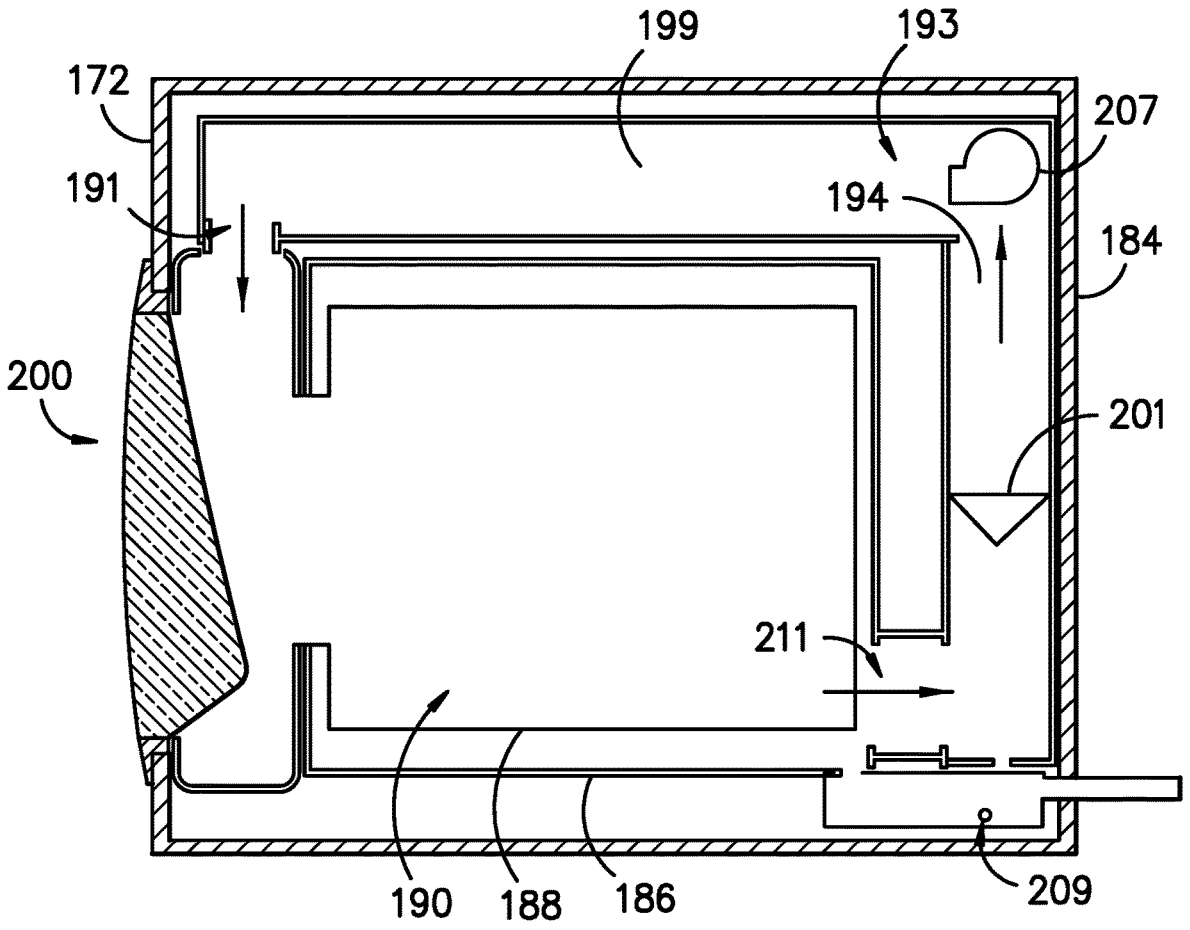
FIG. 4 provides a side cross-sectional view of the dryer appliance of FIG. 3.

For example, referring now to FIGS. 3 and 4, teachings of the present disclosure may also relate to a dryer appliance 170. In particular, FIG. 3 illustrates a perspective view of an exemplary front-load dryer appliance 170 according to the present disclosure, and FIG. 3 illustrates a side cross-sectional view of the exemplary front-load dryer appliance 170 according to the present disclosure. As illustrated, the dryer appliance 170 generally defines a vertical direction V, a lateral direction L, and a transverse direction T, each of which is mutually perpendicular, such that an orthogonal coordinate system is defined. Further, as shown, the dryer appliance 170 may include a cabinet 172 that extends between a top 174 and a bottom 176 along the vertical direction V, between a left side 178 and a right side 180 along the lateral direction L, and between a front 182 and a rear 184 along the transverse direction T.

A laundry tub 186 may be positioned within the cabinet 172 and is generally configured for retaining articles during an operating cycle. Further, the laundry tub 186 may be substantially fixed relative to the cabinet 172 such that it does not rotate or translate relative to cabinet 172. A basket or drum 188 may be received within the laundry tub 186 and may define a drying chamber 190 that is configured for receipt of articles for drying. More specifically, the drum 188 may be rotatably mounted within laundry tub 186 such that it is rotatable about a rotation axis, e.g. via motor 209. Generally, rotation axis is defined non-parallel to the vertical direction V (e.g., closer to perpendicular than parallel). According to the illustrated embodiments, the rotation axis is substantially parallel to the transverse direction T. In this regard, the dryer appliance 170 is generally referred to as a "horizontal-axis" or "front-load" dryer appliance 170. Thus, the laundry tub 186 (e.g., at the front opening 192) may define an uppermost or top apex and a lowermost or bottom apex.

The cabinet 172 may further include a front panel 173 that defines, at least in part, an opening 192 that permits user access to the drum 188 of the laundry tub 186. More specifically, and similar to the washing machine appliance, the dryer appliance 170 may include a door assembly 200 that is positioned over opening 192 and is rotatably mounted to front panel 173 (e.g., about a door axis that is substantially parallel to the vertical direction V). In this manner, the door assembly 200 permits selective access to the opening 192 by being movable between an open position (not shown) facilitating access to the laundry tub 186 and a closed position (FIG. 1) prohibiting access to the laundry tub 186.

Referring particularly to FIG. 4, the laundry tub 186 may also define an air outlet 211 located at a rear portion of the laundry tub 186. For instance, the air outlet 211 may be located at a lower portion of the rear portion of the laundry tub 186. Any suitable location of the air outlet 211 may be incorporated, however. Air having been circulated through the laundry tub 186 (e.g., during a drying operation) may exit laundry tub 186 via air outlet 211 throughout the drying operation. Further, as shown, the laundry tub 186 may define an air inlet 191. Air inlet 191 may be located at an upper front portion of laundry tub 186. Thus, air (e.g., heated air for drying) may enter laundry tub 186 via air inlet 191 to perform a drying operation on laundry items within laundry tub 186 (or drum 188).

The dryer appliance 170 may further include an air circulation duct 193 that defines a passageway through which air may be circulated from air outlet 211 of laundry tub 186 to air inlet 191 of laundry tub 186. The air circulation duct 193 may include a condensing duct 194, a heating plenum 199, and a fan 207 for assisting with air circulation therethrough. Thus, as shown, the condensing duct 194 may extend along a rear-side of cabinet 172 in a predominantly vertical direction (e.g., the vertical direction V). Further, as shown, the condensing duct 194 may extend from a bottom of the laundry tub 186 to the top 104 of the cabinet 172. In some operations, warm moist air that exits laundry tub 186 during a drying operation contacts a relatively cool surface of the condensing duct 194. Accordingly, moisture may condense from the warm air and form water (e.g., water droplets) within the condensing duct 194. The condensing duct 194 may be made from a metal (e.g., aluminum or steel, including alloys thereof) or plastic, for example.

In addition, as shown in FIG. 4, a lint filter 201 may be provided within the condensing duct 194. Thus, the water condensed at or near a top of the condensing duct 194 may flow downward from a position above filter 201 in the vertical direction V. Generally, the filter 201 defines a plurality of filtration apertures to permit air therethrough. Thus, filter 201 may filter out foreign material (e.g., lint, threads, etc.) that exits the laundry tub 186 along with the air. Accordingly, filter 201 may be composed of any suitable material capable of allowing air flow through while restraining foreign materials. In some embodiments, filter 201 is composed of a wire mesh.

Referring back to FIG. 3, and similar to the washing machine appliance 100 described herein, the dryer appliance 170 may also include a control panel 195 including a plurality of input selectors 196 coupled to front panel 173. Thus, as shown, the control panel 195 and input selectors 196 may collectively form a user interface input for operator selection of machine cycles and features. For example, in exemplary embodiments, a display 197 indicates selected features, a countdown timer, or other items of interest to machine users.

Operation of dryer appliance 170 is generally controlled by a controller or processing device 198. In some embodiments, the controller 198 is in operative communication with (e.g., electrically or wirelessly connected to) the control panel 195 for user manipulation to select machine cycles and features. In response to user manipulation of control panel 195, the controller 198 operates the various components of the dryer appliance 170 to execute selected machine cycles and features (e.g., as part of a drying operation).

The controllers 166, 198 described herein may include a memory (e.g., non-transitive memory) and microprocessor, such as a general or special purpose microprocessor operable to execute programming instructions or micro-control code associated with a wash or dry operation. The memory may represent random access memory such as DRAM, or read only memory such as ROM or FLASH. In one embodiment, the processor executes programming instructions stored in memory. The memory may be a separate component from the processor or may be included onboard within the processor. Alternatively, the controllers 166, 198 may be constructed without using a microprocessor (e.g., using a combination of discrete analog or digital logic circuitry, such as switches, amplifiers, integrators, comparators, flip-flops, and gates, and the like) to perform control functionality instead of relying upon software. Furthermore, the control panels 164, 195 and other components of the appliances 100, 170, such as a motor assembly and a dispensing assembly, may be in operative communication with the controllers 166, 198 via one or more signal lines or shared communication busses.

While described in the context of a specific embodiment of front load dryer appliance 170, using the teachings disclosed herein it will be understood that front load dryer appliance 170 is provided by way of example only. Other laundry treatment appliances having different configurations, different appearances, or different features may also be utilized with the present subject matter as well.

Referring now generally to FIGS. 5 through 17, a door assembly 200 will be described in more detail according to various exemplary embodiments of the present subject matter. Although the discussion below refers to the door assembly 200, one skilled in the art will appreciate that the features and configurations described may be used for other door assemblies in other appliances as well. Other variations and modifications of the exemplary embodiment described below are possible, and such variations are contemplated as within the scope of the present subject matter.

As shown generally in the figures, the door assembly 200 includes a primary door 202 rotatably mounted to a front panel 212 of the appliance 100 to permit selective access to the opening 216 (e.g. openings 132, 192) and a secondary door 204 secured on an exterior side of the primary door 202. Further, as shown particularly in FIGS. 5-7, the primary door 202 may also include a window 214 for permitting viewing of the contents within the appliance 100, e.g. within the wash basket 120 or the drum 188, when the primary door 202 and the secondary door 204 are in the closed position. Although the door assembly 200 is illustrated as mounted to the front panel 212 of the appliance 100, it should be appreciated that the door assembly 200 may be mounted to another side of the appliance 100 or any other suitable support according to alternative embodiments.

Notably, the primary and secondary doors 202, 204 may be formed from any suitable materials. For example, in some embodiments, the primary and secondary doors 202, 204 may be formed from a plastic. More specifically, for example, the primary and secondary doors 202, 204 may be injection molded, and may thus be formed from an injection molded material such as an injection molded plastic. Notably, the plastic may be clear, e.g., to define the window 214 or otherwise permit viewing of the contents within the appliance 100 during operation of the appliance 100.

Figure 6:
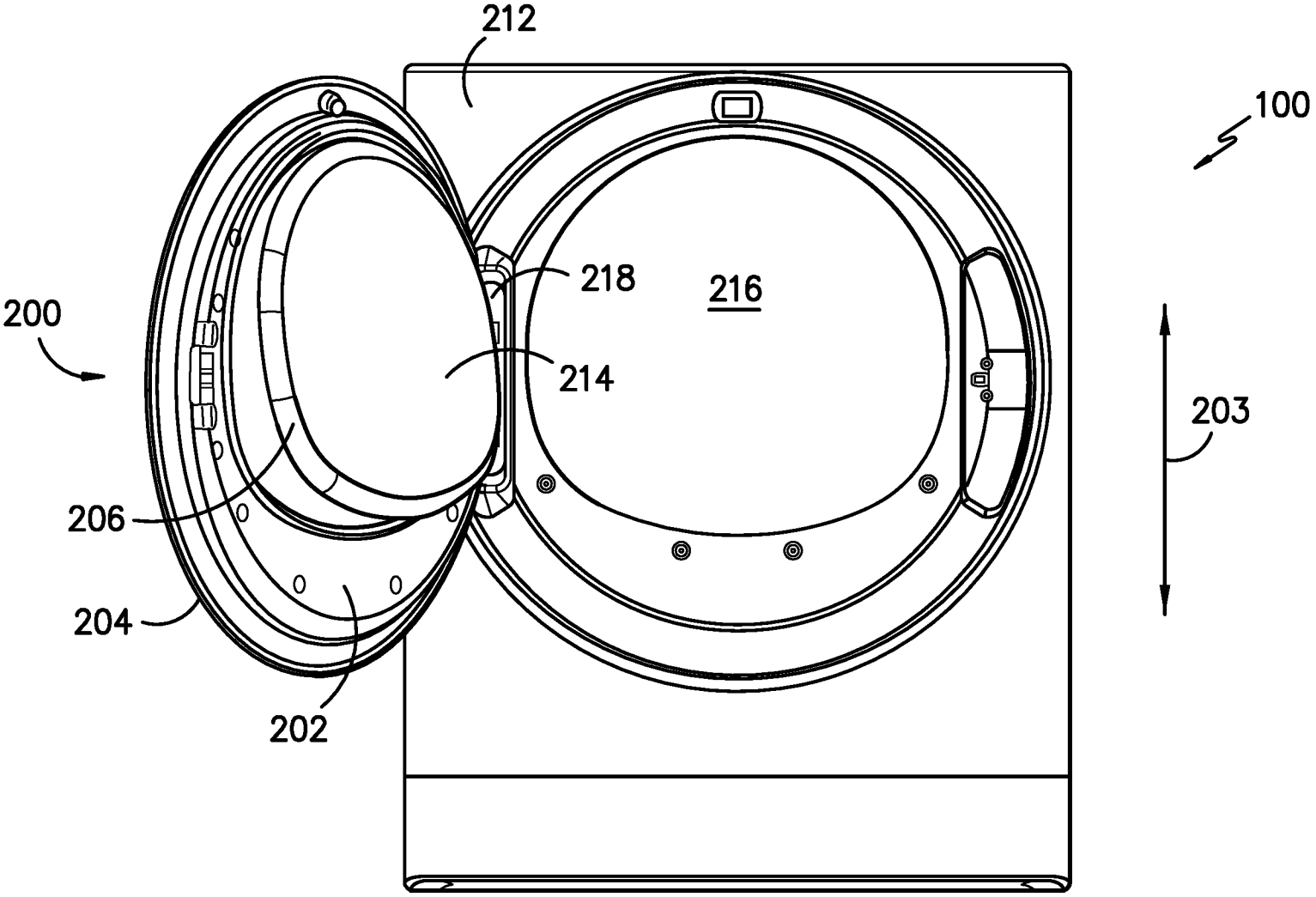
FIG. 6 provides a front view of the appliance of FIG. 5, particularly illustrating the door assembly in an open position.
Figure 7:
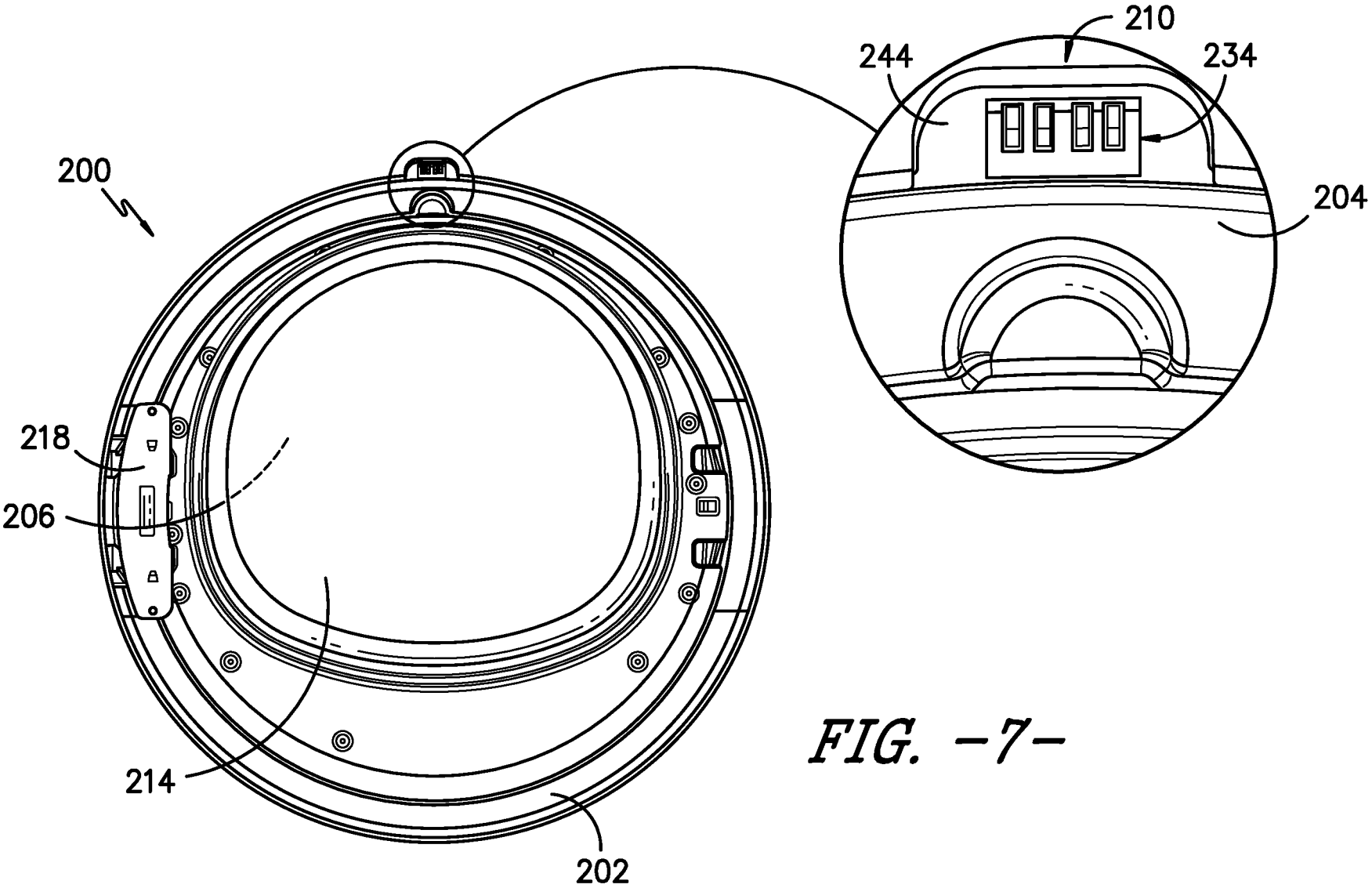
FIG. 7 provides an internal view of the door assembly of FIG. 6 according to an exemplary embodiment of the present subject matter.
Figure 8:
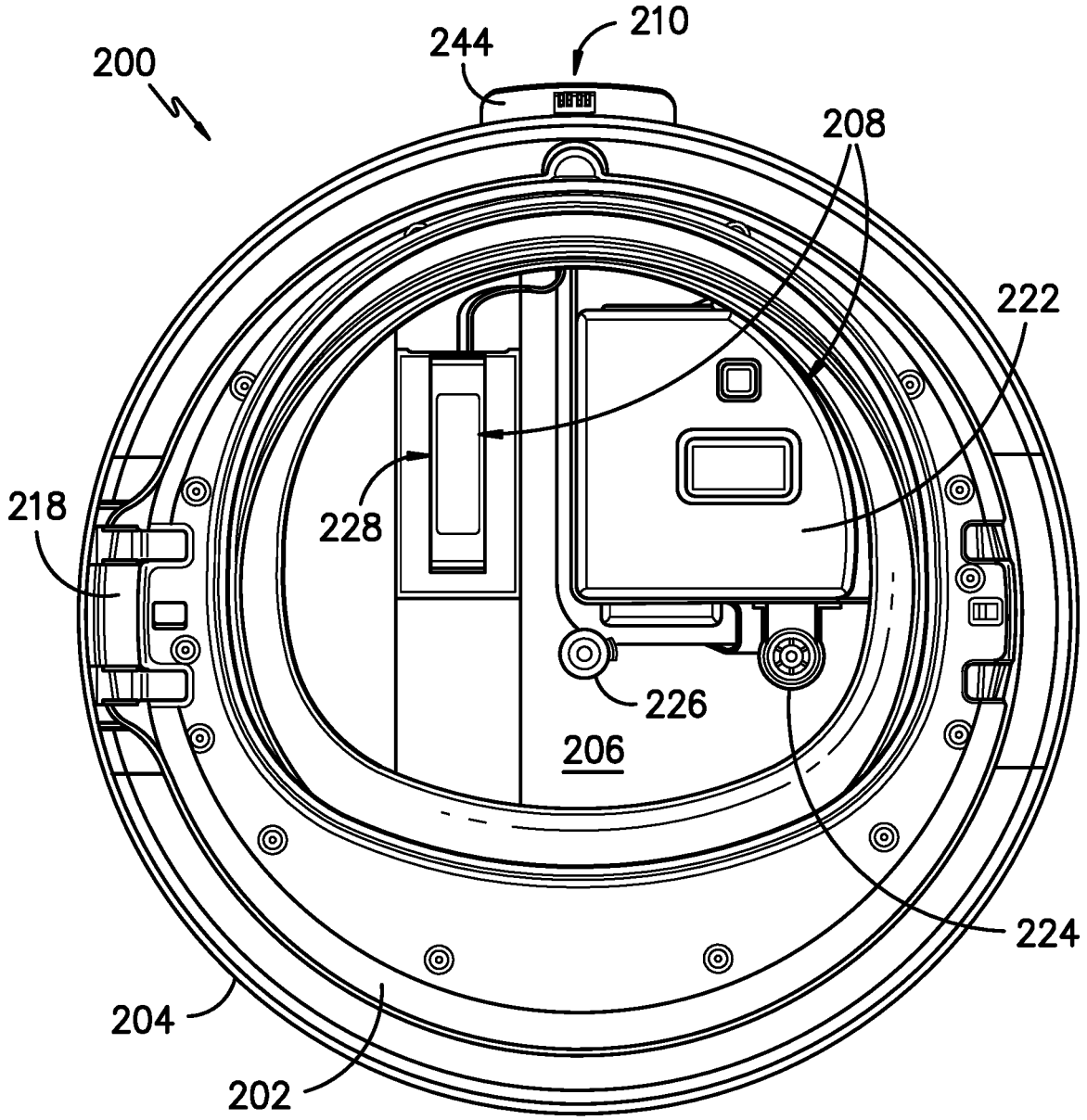
FIG. 8 provides an internal view of the door assembly of FIG. 7 according to an exemplary embodiment of the present subject matter, particularly illustrating the window of the door assembly removed to illustrate internal electrical components within an interior cavity of the door assembly.
Figure 11:
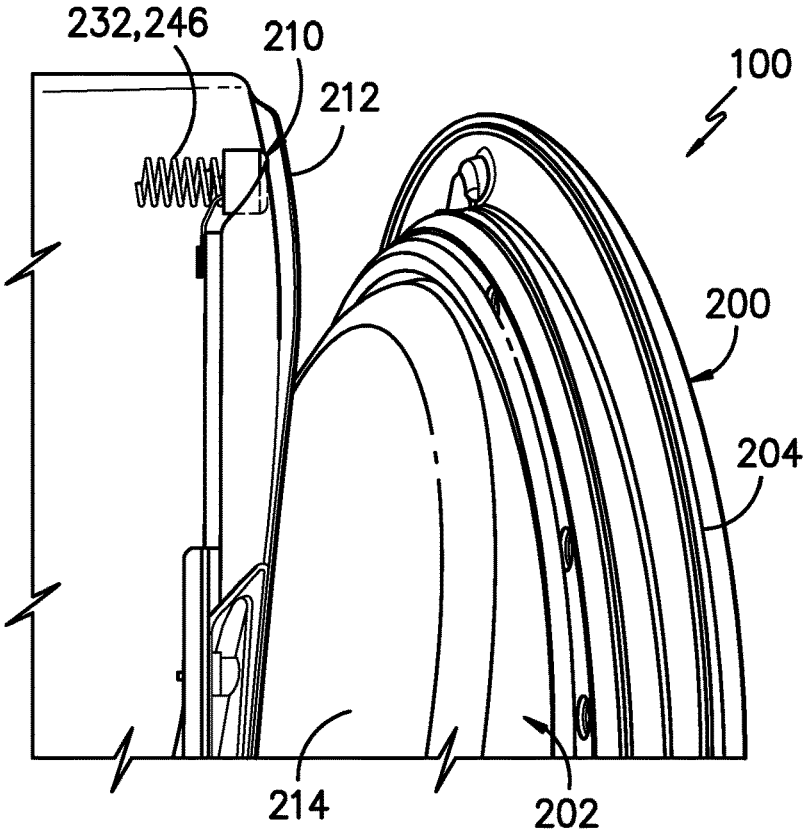
FIG. 11 provides a partial, perspective view of the door assembly according to an exemplary embodiment of the present subject matter, particularly illustrating the electrical closing mechanism of the door assembly configured as inductive coils.
Figure 12:
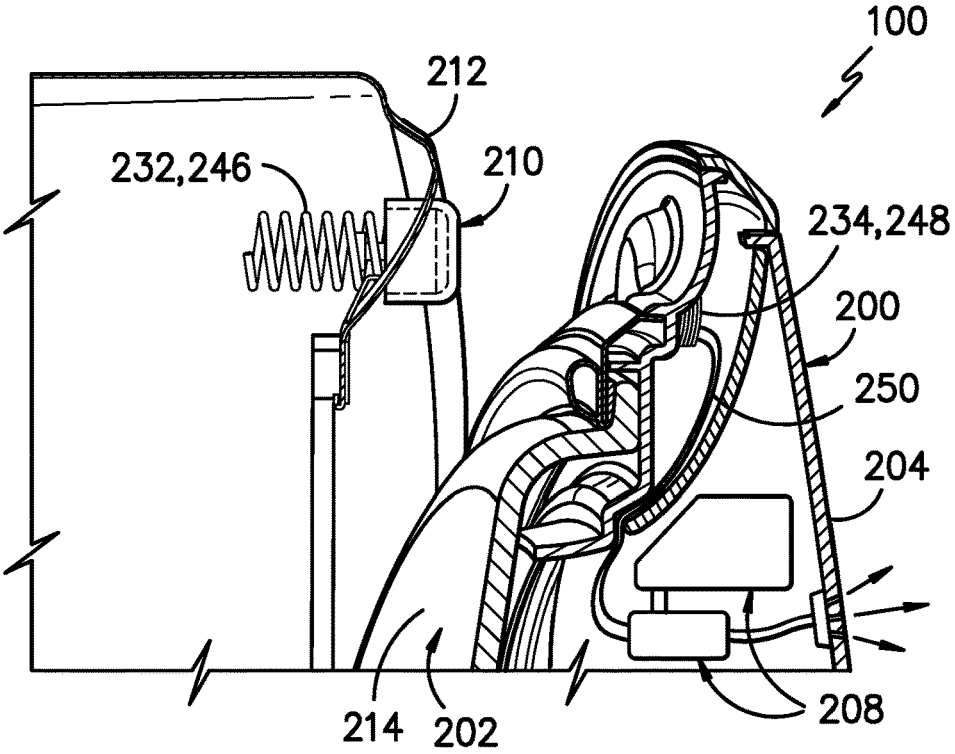
FIG. 12 provides an internal, perspective view of the door assembly of FIG. 11 according to an exemplary embodiment of the present subject matter, particularly illustrating the electrical closing mechanism of the door assembly configured as inductive coils.
Figure 13:
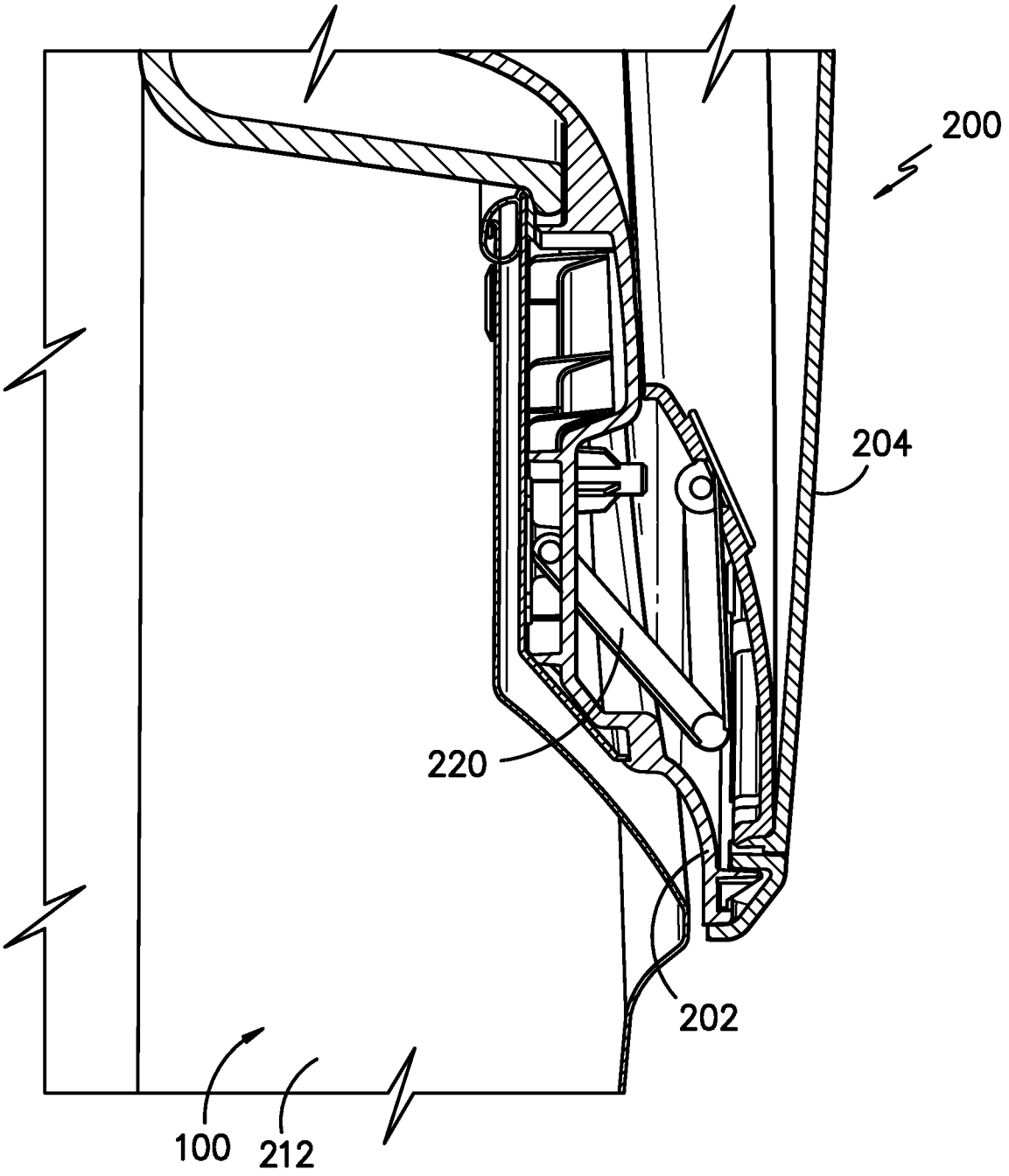
FIG. 13 provides a partial, perspective view of the door assembly according to an exemplary embodiment of the present subject matter, particularly illustrating a primary door of the door assembly being in a closed position.
Figure 14:
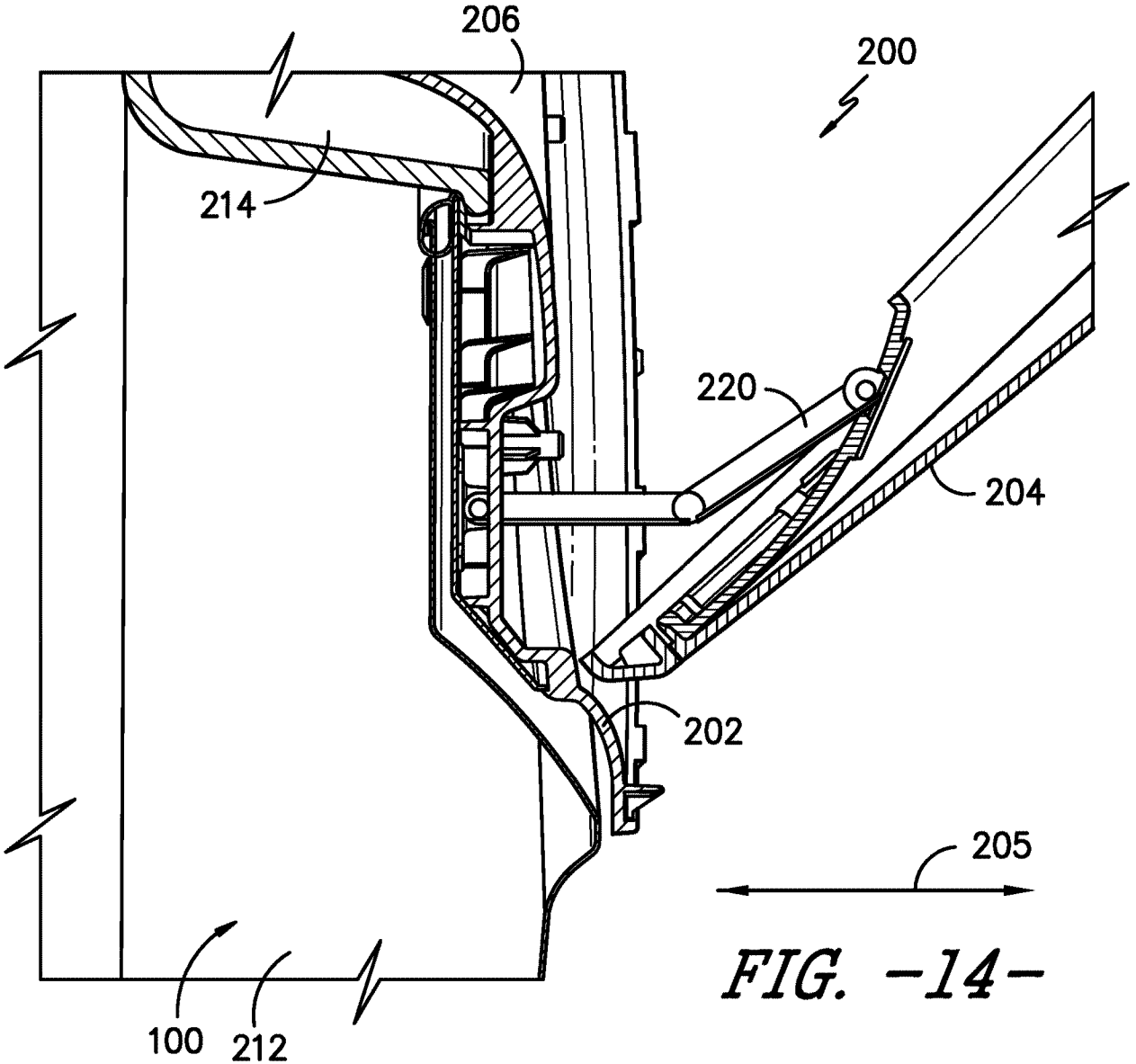
FIG. 14 provides a partial, perspective view of the door assembly of FIG. 13 according to an exemplary embodiment of the present subject matter, particularly illustrating the primary door of the door assembly being in an open position by rotating the primary door via a second hinge.

In particular embodiments, as shown in FIGS. 6 and 11-12, the primary door 202 and the secondary door 204 are rotatable together about the door axis 203 of the appliance 100. For example, as shown and as mentioned, the door axis 203 may be substantially parallel to the vertical direction V. Moreover, as shown in FIGS. 6-8, in one embodiment, the primary door 202 and the secondary may be rotatable together via a first hinge 218 secured to the front panel 212. In addition, as shown in FIGS. 13 and 14, the secondary door 204 is rotatable with respect to the primary door 202 about a secondary axis 205 of the appliance 100. In such embodiments, as shown, the secondary axis 205 may be substantially parallel to the lateral direction L of the appliance 100. Thus, as shown in FIG. 14, when the secondary door 204 is rotated with respect to the primary door 202 to an open position, the primary door 202 remains in a closed position and prohibits access to the opening 216. Moreover, in such embodiments, as shown in FIGS. 13 and 14, the secondary door 204 may rotatable with respect to the primary door 202 via a second hinge 220 secured to the primary door 202.

Figure 5:
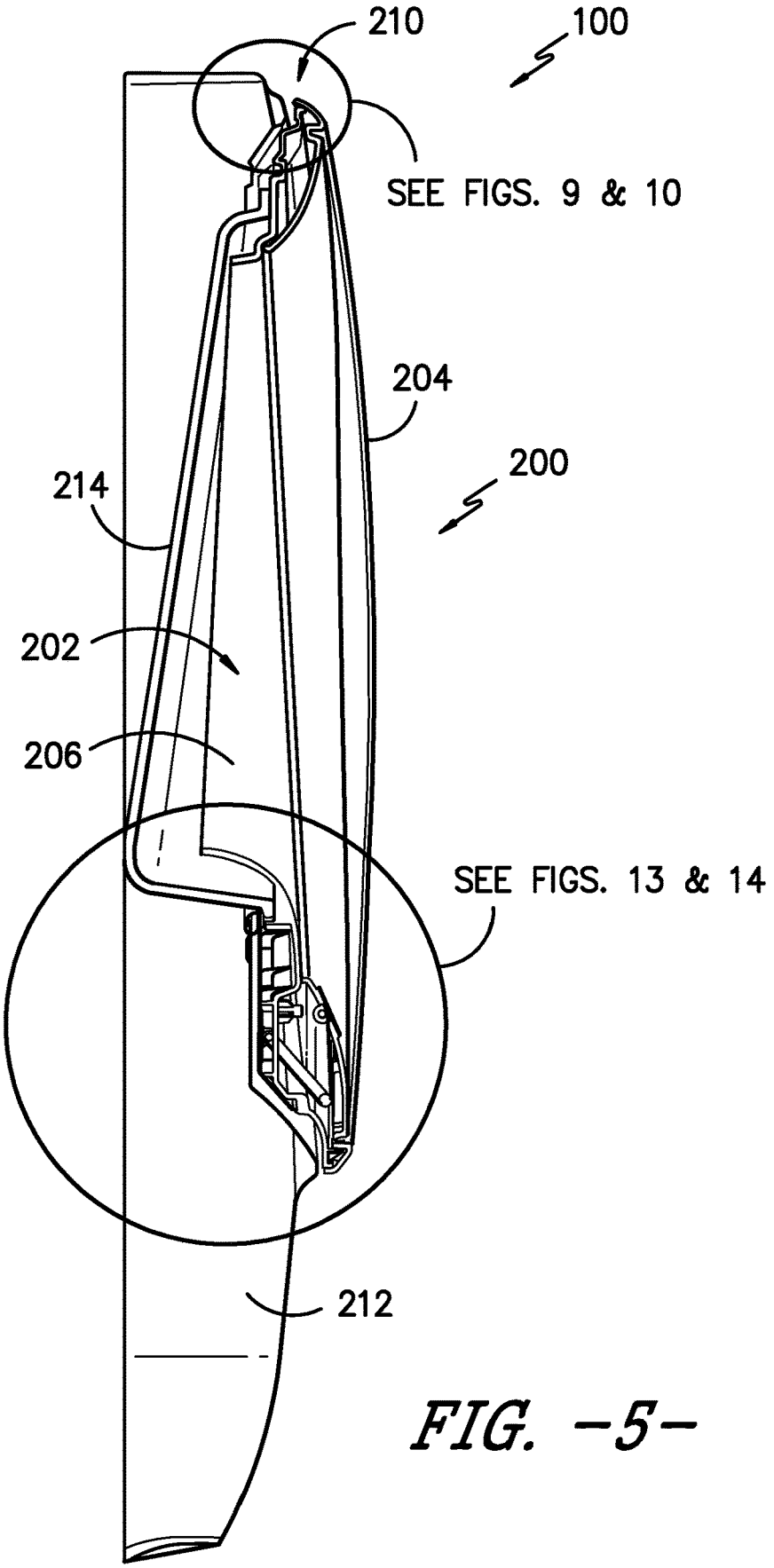
FIG. 5 provides a side view of an appliance having a door assembly according to exemplary embodiments of the present disclosure.

Referring particularly to FIGS. 5-8, the door assembly 200 also includes an interior cavity 206 defined between the primary door 202 and the secondary door 204. In particular, FIG. 5 provides a side view of the appliance 100 having the door assembly 200 according to exemplary embodiments of the present disclosure. FIG. 6 provides a front view of the appliance 100 of FIG. 5, particularly illustrating the door assembly 200 in an open position. FIG. 7 provides an internal view of the door assembly of FIG. 6 according to an exemplary embodiment of the present subject matter. FIG. 8 provides an internal view of the door assembly of FIG. 7 according to an exemplary embodiment of the present subject matter, with certain components removed to illustrate the interior cavity 206 of the door assembly 200. Accordingly, FIGS. 5-8 generally illustrate the interior cavity 206 of the door assembly 200.

Figure 15:
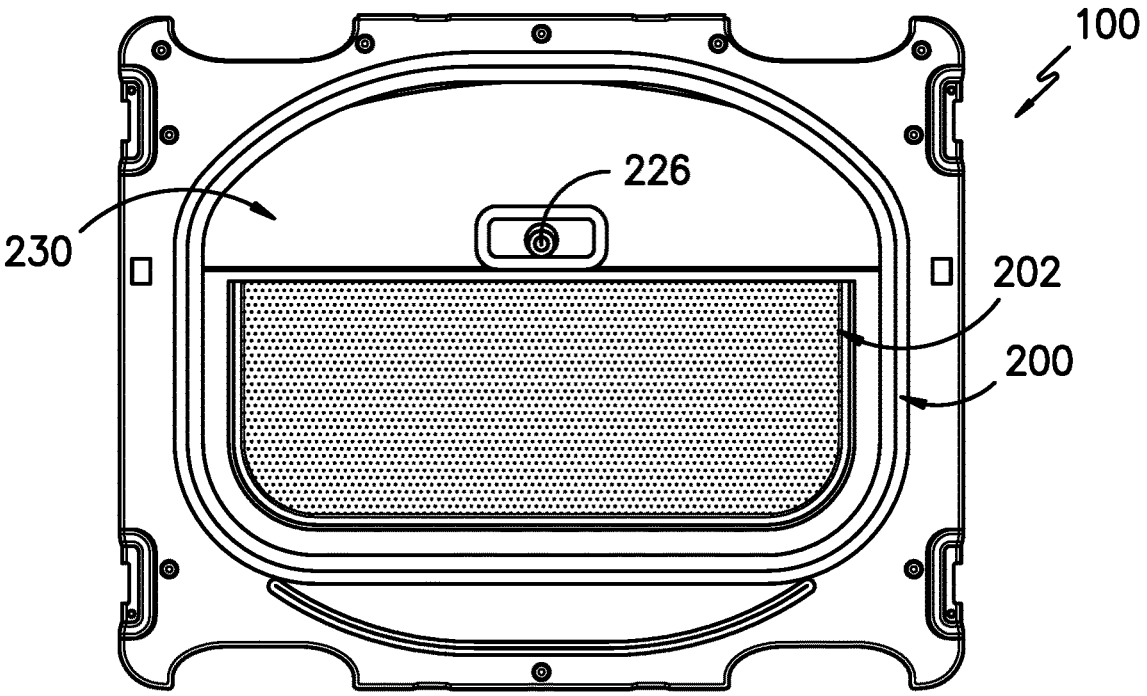
FIG. 15 provides a front view of a secondary door of the door assembly according to an exemplary embodiment of the present subject matter, particularly illustrating the secondary door of the door assembly as viewed by a user when the primary door is in the open position with respect to the secondary door.
Figure 16:
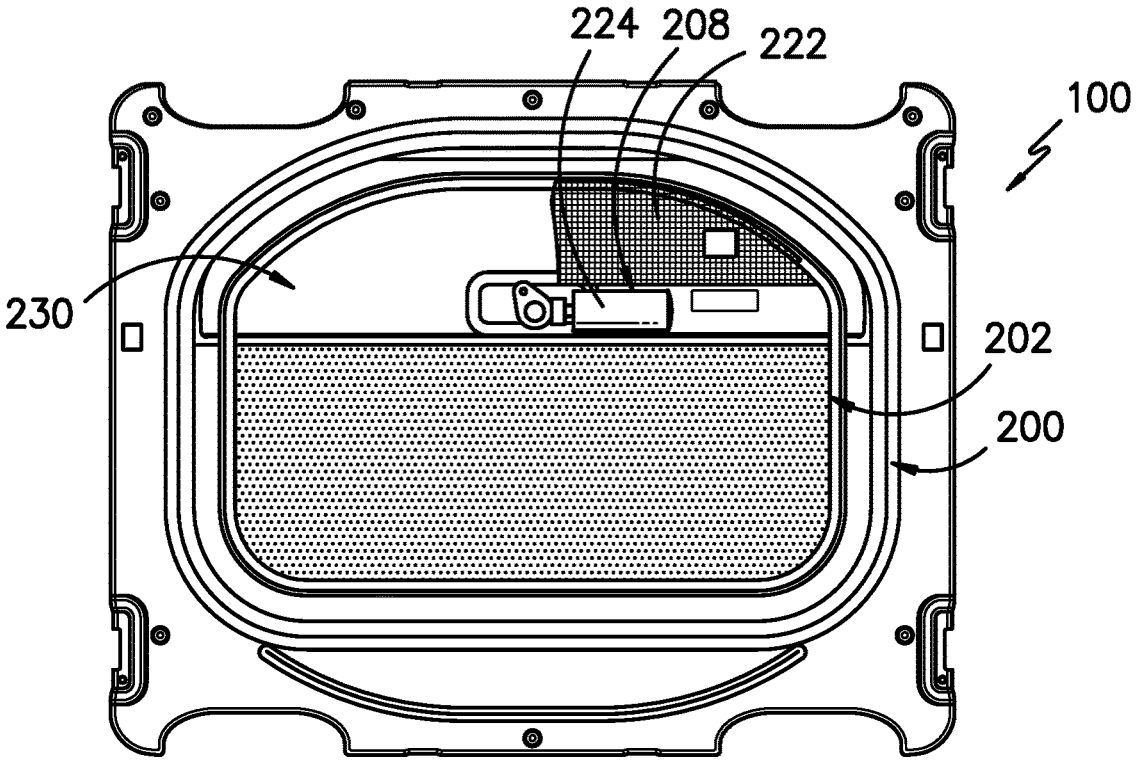
FIG. 16 provides a rear view of the secondary door of the door assembly of FIG. 15 according to an exemplary embodiment of the present subject matter, particularly illustrating the secondary door of the door assembly as viewed from within the appliance.
Figure 17:
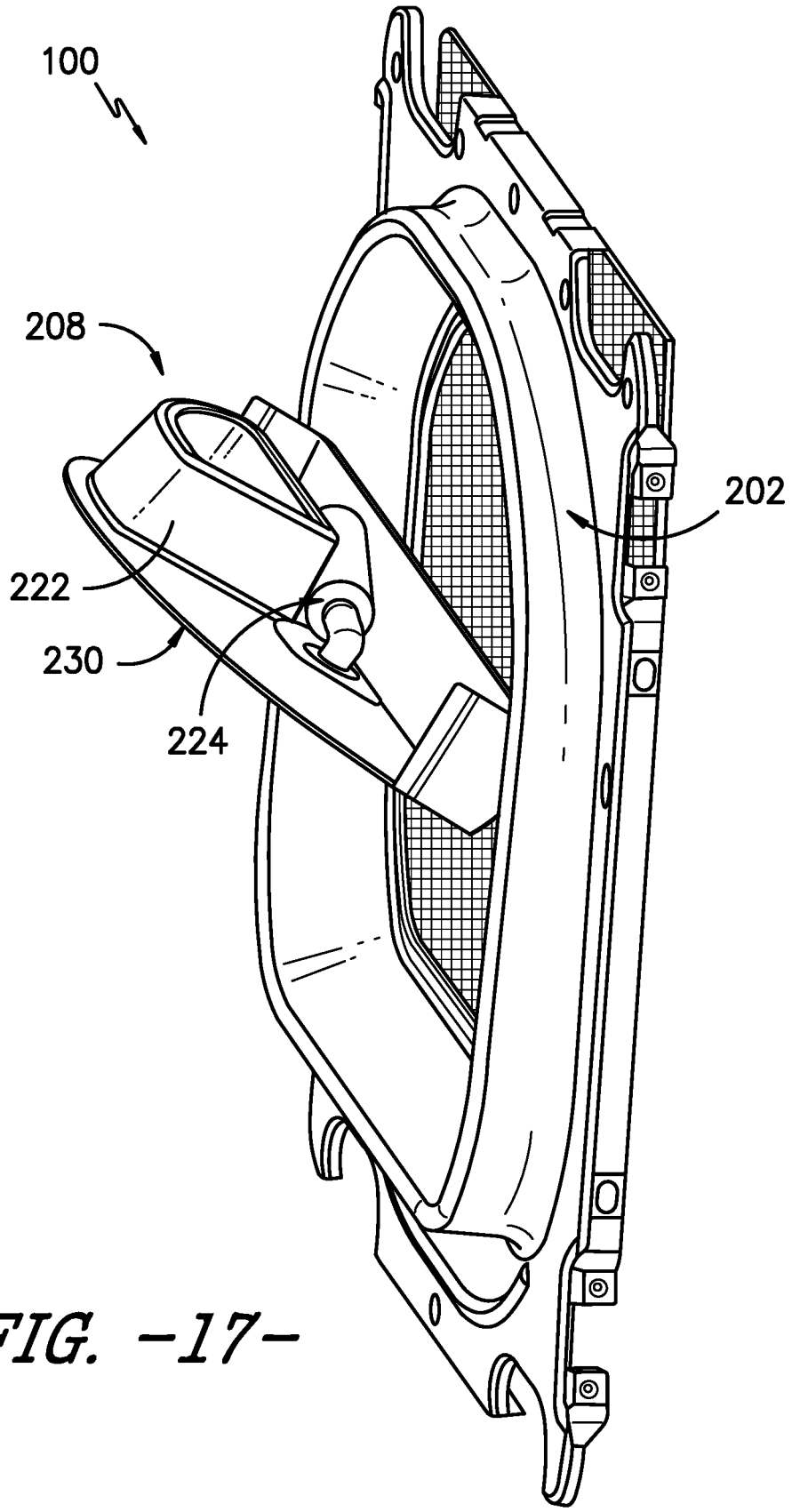
FIG. 17 provides a perspective view of a secondary door of the door assembly according to an exemplary embodiment of the present subject matter, particularly illustrating a compartment secured to the secondary door in an open position.

Thus, as shown particularly in FIGS. 8, 12, and 15-17, the door assembly 200 may further include one or more electrical components 208 or systems that require electrical power arranged within the interior cavity 206. For example, in certain embodiments, the electrical component(s)/system(s) 208 may include a scent dispensing system, a water mist system, a pre-treat system, a UV light 228 (e.g. a UVC LED lamp, UV clamp, or similar) (FIG. 8), or any other components that can be used with the appliance 100. More specifically, as shown in FIGS. 8, 12, and 15-17, the various systems described herein may include a tank 222 containing a fluid (not shown), a pump 224 in fluid communication with the tank 222, and a nozzle 226 in fluid communication with the pump 224 for dispensing the fluid. More specifically, as shown in FIG. 17, the nozzle 226 can be arranged with the primary door 202 such that the nozzle 226 is exposed when the secondary door 204 is rotated with respect to the primary door 202 to the open position. Thus, when the secondary door 204 is open with respect to the primary door 202, a user can access the nozzle 226 for treating articles prior to placing the articles into the appliance 100.

Referring particularly to FIG. 8, the electrically-powered systems or electrical components described herein may be located at any location within the interior cavity 206 of the door assembly 200. In addition, as shown in FIGS. 15-17, the door assembly 200 may include an additional compartment 230 for receiving the electrically-powered systems or electrical components described herein. Furthermore, as shown, the compartment 230 may be movably secured to the primary door 202 in the interior cavity 206. More specifically, as shown in FIG. 17, the compartment 230 may be rotatable between an open position and a closed position to permit selective access to the one or more electrical components.

In addition, as shown in FIGS. 7 and 9-12, the door assembly 200 includes an electrical closing mechanism 210 for securing the primary door 202 and the secondary door 204 in a closed position. Thus, when the primary door 202 and the secondary door 204 are in the closed position (as shown in FIG. 5), the electrical closing mechanism 210 powers the electrical component(s) 208.

Figure 9:
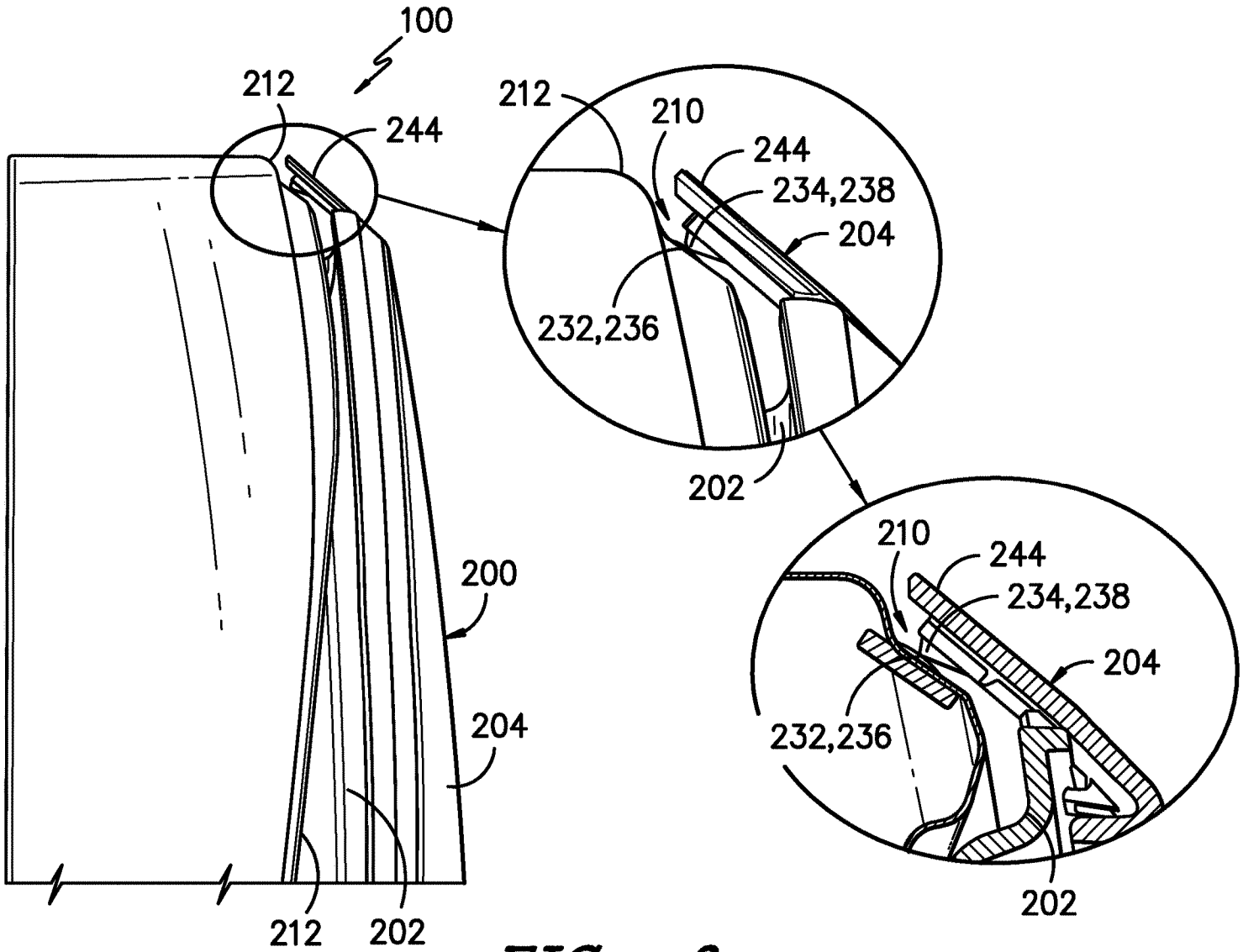
FIG. 9 provides a partial, detailed view of the door assembly of FIG. 5 according to an exemplary embodiment of the present subject matter, particularly illustrating the electrical closing mechanism of the door assembly configured as sliding electrical contacts.
Figure 10:
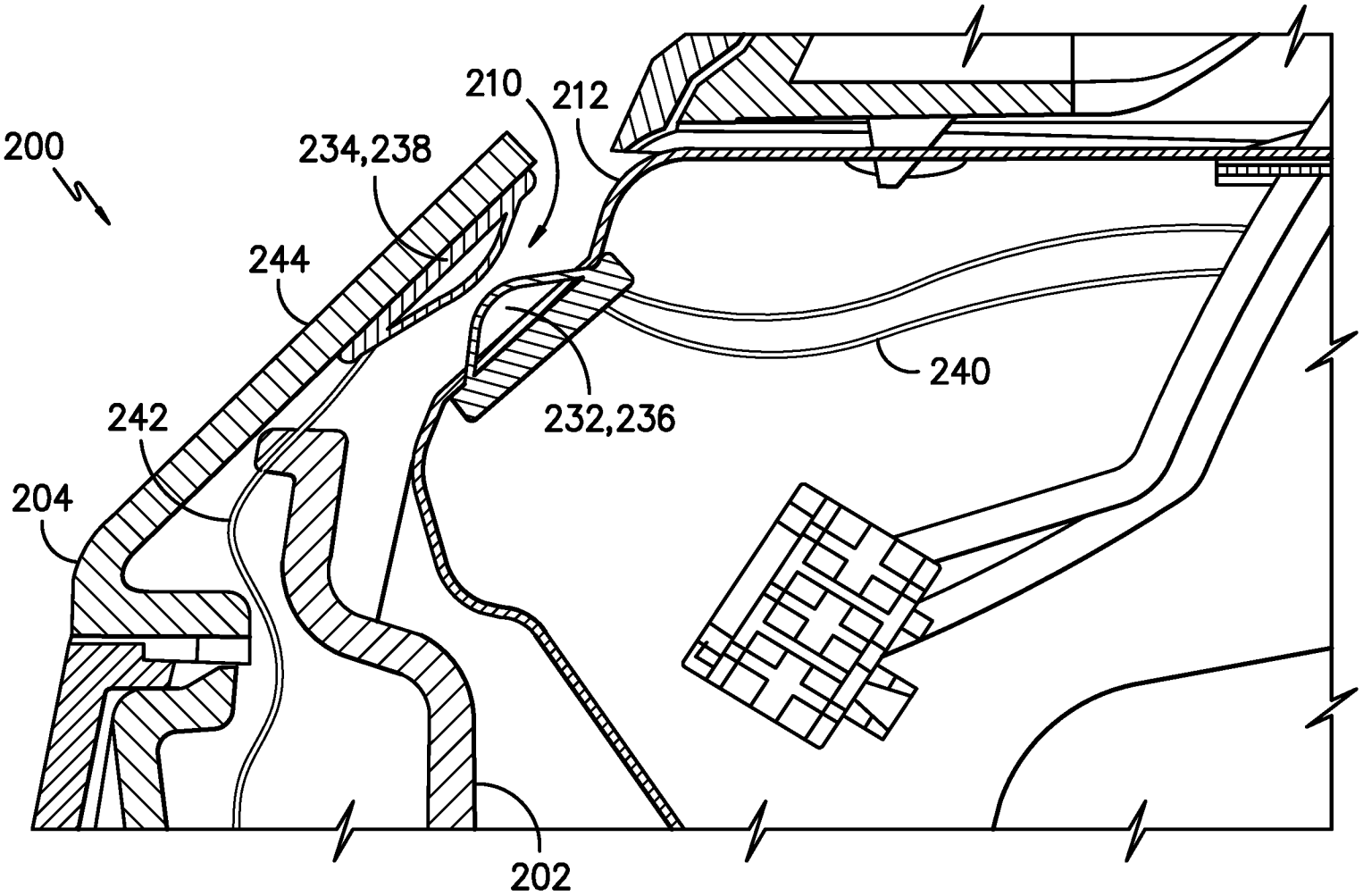
FIG. 10 provides an internal, cross-sectional view of the door assembly of FIG. 9 according to an exemplary embodiment of the present subject matter, particularly illustrating wiring associated with the electrical closing mechanism of the door assembly.

More specifically, as shown in FIGS. 7, 9, and 10, the electrical closing mechanism 210 may include a first electrical connector 232 secured on the front panel 212 of the appliance and a second electrical connector 234 secured on the secondary door 204. For example, as shown in FIGS. 7-10, the secondary door 204 may include an extension portion 244, such as a leaf spring, with the second electrical connector 234 being positioned on the extension portion 244. In particular, as shown in FIGS. 9 and 10, the first and second electrical connectors 232, 234 may be first and second sliding electrical contacts 236, 238. For example, as shown in FIG. 10, the first sliding electrical contact 236 may be secured on the front panel 212 of the appliance 100 and electrically coupled to the appliance controller (e.g. controllers 166, 198) via a first wired connection 240. Moreover, as shown, the second sliding electrical contact 238 may be secured to the extension portion 244 on the secondary door 204 of the appliance 100 and electrically coupled to the various electrical component(s) 208 within the door assembly 200 via a second wired connection 242. In such embodiments, as shown in FIGS. 9 and 10, the first electrical connector 232 directly contacts the second electrical connector 234 when the when the primary door 202 and the secondary door 204 are in the closed position. In further embodiments, the first and second electrical connectors 232, 234 may be any other suitable electrical connector in addition to sliding electrical contacts, such as first and second spring-loaded pins.

In still alternative embodiments, as shown in FIGS. 11 and 12, the first and second electrical connectors 232, 234 may include first and second inductive coils 246, 248. In particular, as shown, the first inductive coil 246 may be secured to the front panel 212 of the appliance and the second inductive coil 248 may be secured to the door assembly 200. Thus, when the primary door 202 and the secondary door 204 are in the closed position, the first and second inductive coils 246, 248 are electrically connected but do not contact each other. Rather, the first and second inductive coils 246, 248 are arranged together to provide contact-less transmission of power and/or data as needed. Furthermore, as shown particularly in FIG. 12, the second inductive coil 248 may include a wired connection 250 for coupling the second inductive coil 248 to the various electrical component(s) 208 within the door assembly 200.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An appliance, comprising:

a cabinet including a front panel, the front panel defining an opening;

a tub positioned within the cabinet;

a basket rotatably mounted within the tub, the basket defining a chamber for receiving articles for washing or drying; and a door assembly positioned proximate the opening, the door assembly comprising:

a primary door rotatably mounted to the front panel to permit selective access to the opening;

a secondary door secured on an exterior side of the primary door;

an interior cavity defined between the primary door and the secondary door;

one or more electrical components arranged within the interior cavity; and an electrical closing mechanism for securing the primary door and the secondary door in a closed position, wherein, when the primary door and the secondary door are in the closed position, the electrical closing mechanism powers the one or more electrical components, and wherein the one or more electrical components are positioned in a compartment movably secured to the primary door in the interior cavity.

2. The appliance of claim 1, wherein the primary door further comprises a window for permitting viewing of the basket when the primary door and the secondary door are in the closed position.

3. The appliance of claim 1, wherein the primary door and the secondary are rotatable together about a door axis of the appliance, the door axis being parallel to a vertical direction, wherein the secondary door is rotatable with respect to the primary door about a secondary axis of the appliance, the secondary axis being parallel to a lateral direction of the appliance.

4. The appliance of claim 3, wherein, when the secondary door is rotated with respect to the primary door to an open position, and wherein the primary door remains in the closed position and prohibits access to the opening.

5. The appliance of claim 3, wherein the primary door and the secondary door are rotatable together via a first hinge secured to the front panel.

6. The appliance of claim 5, wherein the secondary door is rotatable with respect to the primary door via a second hinge secured to the primary door.

7. The appliance of claim 4, wherein the one or more electrical components comprise at least one of a scent dispensing system, a water mist system, a pre-treat system, or a UV light.

8. The appliance of claim 7, wherein at least one of the scent dispensing system, the water mist system, or the pre-treat system comprises a tank containing a fluid, a pump in fluid communication with the tank, and a nozzle in fluid communication with the pump for dispensing the fluid, the nozzle being exposed when the secondary door is rotated with respect to the primary door to the open position.

9. The appliance of claim 1, wherein the compartment is rotatable between an open position and a closed position to permit selective access to the one or more electrical components.

10. The appliance of claim 1, wherein the electrical closing mechanism comprises a first electrical connector secured on the front panel of the cabinet and a second electrical connector secured on the secondary door.

11. The appliance of claim 10, wherein the first and second electrical connectors comprise at least one of first and second sliding electrical contacts or first and second spring-loaded pins.

12. The appliance of claim 10, wherein the first electrical connector directly contacts the second electrical connector when the primary door and the secondary door are in the closed position.

13. The appliance of claim 10, wherein the secondary door comprises a leaf spring, the second electrical connector being positioned on the leaf spring.

14. The appliance of claim 10, wherein the first and second electrical connectors comprise first and second inductive coils, wherein, when the primary door and the secondary door are in the closed position, the first and second electrical connectors are electrically connected but do not contact each other.

15. The appliance of claim 1, wherein the appliance is one of a washing machine appliance or a dryer appliance.

16. A door assembly for a horizontal axis appliance, the appliance having a cabinet including a front panel defining an opening and a tub positioned within the cabinet, the door assembly comprising:

a primary door rotatably mounted to the front panel to permit selective access to the opening;

a secondary door secured on an exterior side of the primary door;

an interior cavity defined between the primary door and the secondary door;

one or more electrical components arranged within the interior cavity; and an electrical closing mechanism for securing the primary door and the secondary door in a closed position, wherein, when the primary door and the secondary door are in the closed position, the electrical closing mechanism powers the one or more electrical components, and wherein the one or more electrical components are positioned in a compartment movably secured to the primary door in the interior cavity.

17. The door assembly of claim 16, wherein the primary door and the secondary door are rotatable together about a door axis of the appliance, the door axis being parallel to a vertical direction, wherein the secondary door is rotatable with respect to the primary door about a secondary axis of the appliance, the secondary axis being parallel to a lateral direction of the appliance.

18. The door assembly of claim 17, wherein, when the secondary door is rotated with respect to the primary door to an open position, the primary door remains in a closed position and prohibits access to the opening.

19. The door assembly of claim 16, wherein the electrical closing mechanism comprises a first electrical connector secured on the front panel of the cabinet and a second electrical connector secured on the secondary door.

* * * * *